US005096191A

United States Patent [19]

Fang

[11] Patent Number: 5,096,191

[45] Date of Patent: Mar. 17, 1992

[54] BASKETBALL TYPE BALL THROWING TRAINING AND AMUSEMENT APPARATUS

[76] Inventor: David Y. Fang, No. 178 Chang Sui Road, Changhwa, Taiwan

[21] Appl. No.: 643,895

[22] Filed: Jan. 22, 1991

[51] Int. Cl.[5] ..... A63B 63/08

[52] U.S. Cl. ..... 273/1.5 R; 273/400

[58] Field of Search ..... 273/1.5 R, 1.5 A, 400, 273/401

[56] References Cited

U.S. PATENT DOCUMENTS

| | | | |
|---|---|---|---|
| 1,211,379 | 1/1917 | Maisch | 273/400 X |
| 2,827,297 | 3/1958 | Foster | 273/401 |
| 4,826,166 | 5/1989 | Baker et al. | 273/400 X |
| 4,936,577 | 6/1990 | Kington | 273/1.5 A |
| 4,940,232 | 7/1990 | Chen | 273/1.5 R |
| 5,037,095 | 8/1991 | Nedwick | 273/400 X |

*Primary Examiner*—Paul E. Shapiro

[57] ABSTRACT

A basketball type ball throwing training and amusement apparatus comprising: a backboard, a target hoop, an auxiliary hoop, a collection hoop; an innermost net suspended from the target hoop, a second net suspended from the auxiliary hoop, an outermost net suspended from the collection hoop; a loop closure cord wrapped around the lower openings of each net; a plurality of threaded fasteners and securing brackets for securing each hoop to the backboard; and a throwing ball. Wherein, all three hoops are concentrically disposed on the backboard with the target hoop being the smallest and the collection loop the largest. The hanging nets can be closed by pulling in the loop closure cords.

1 Claim, 2 Drawing Sheets

BASKETBALL TYPE BALL THROWING TRAINING AND AMUSEMENT APPARATUS

BACKGROUND OF THE PRESENT INVENTION

The present invention relates to an apparatus for training in ball throwing and more particularly to a basketball type ball throwing training and amusement apparatus.

While basketball type ball throwing apparatus have previously been set forth, they suffer from several deficiencies.

Most notably basketball type ball throwing apparatus as described in U.S. Pat. Nos. 2,886,321 (Tarte, May 12, 1959), 2,893,734 (Tarte, July 7, 1959), and 3,050,304 (Hulsebus, Aug. 21, 1962) though providing multiple hoops of differing diameter and hence difficulty, all place them in separate positions forcing a user to change his position or aiming point. A more ideal apparatus would provide multiple hoops in concentric positions whereby a user would have a single aiming point as he would in actual play as from a foul line.

The distribution of balls passing through each of the multiple hoops would then give an accurate indication of the user's proficiency and progress over time.

While the basketball type ball throwing apparatus offered in U.S. Pat. No. 4,936,577 (Kington, Oct. 1987) does provide two concentric hoops, the smaller of the hoops is positioned below the larger hoop and surrounded by its net. The smaller hoop would thus not present a realistic target for the user as a user would not have access to the hoop except at unusual angles of throw not reflected in real play. Moreover, the larger hoop and attached net would serve to obscure the smaller hoop which should be salient as the main goal.

The basketball type throwing training and amusement apparatus of the present invention overcomes these deficiencies by providing multiple hoops with a main target hoop that can be readily accessed either by rebound off a backboard or direct entry and that is clearly visible.

An auxiliary hoop positioned below the target hoop readily recieves balls that miss the target hoop by a small margin or rebound off its rim at near glancing angles.

Moreover, the attached nets of all hoops can be closed at their lower ends to accumulate balls that enter allowing a user to concentrate on throwing the ball while quick and accurate score keeping can be made afterwards.

SUMMARY OF THE PRESENT INVENTION

The basketball type throwing training and amusement apparatus of the present invention has as a first objective a basketball type throwing training and amusement apparatus which has multiple hoops of varying diameter and difficulty in scoring goals in concentric positions and a second objective of a basketball type throwing training and amusement apparatus that has closeable nets to allow accumulation of thrown balls for the purpose of simplified scoring.

The basketball type throwing training and amusement apparatus of the present invention comprises a flat backboard, a target hoop, an auxiliary hoop, a collection hoop, a net hung from each hoop, and at least one throwing ball.

The hoops are all secured to the backboard and are positioned concentrically with the target hoop being the innermost and smallest.

The auxiliary hoop is positioned between the target hoop and the collection hoop, being displaced vertically below the target hoop and having a larger diameter such that a throwing ball can readily pass through the space between the two.

The collection hoop is outermost and largest and is vertically displaced a slight distance below the target hoop. Its size and position allows it to gather most errant balls.

A user can thus practice his aim by throwing balls with the target hoop as the main goal while the auxiliary hoop presents an easier secondary target, fullfilling the first objective of the present invention.

The nets which hang form the hoops are not all of the same length, with the net of the collection hoop being the longest and enveloping the other two. The net of the target hoop is of the shortest length and innermost.

A loop closure cord is provided on the lower openings of each net. By closing these, any ball that passes through a given hoop will be collected in a respective net. A user can thus throw several balls, while concentrating on the game, and retrieve them later for quick score keeping. Thus, the second objective of the present invention is attained.

EMBODIMENT OF THE PRESENT INVENTION

Figure 1:
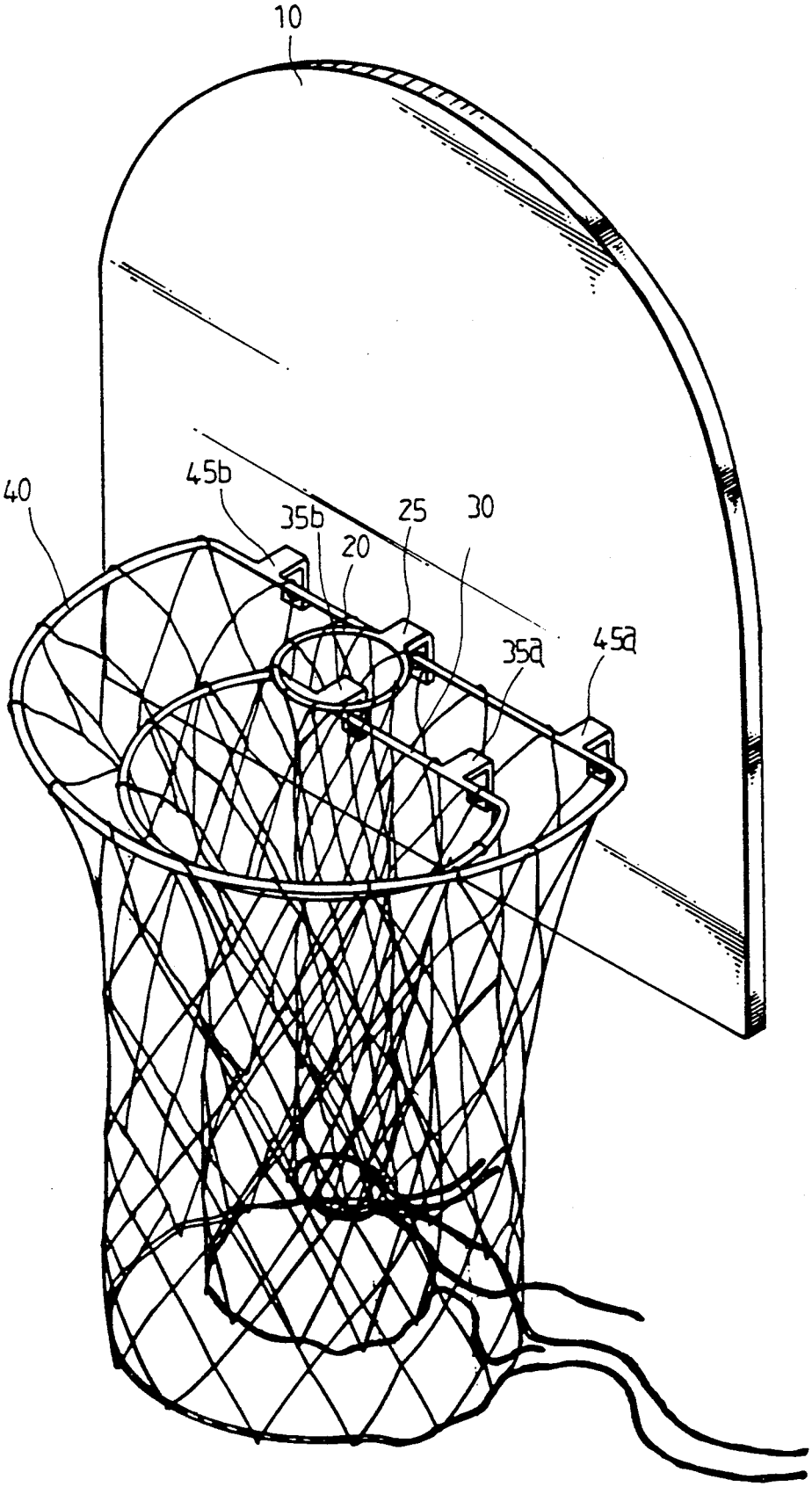
FIG. 1 is a perspective view of the basketball type training and amusement apparatus of the present invention.
Figure 2:
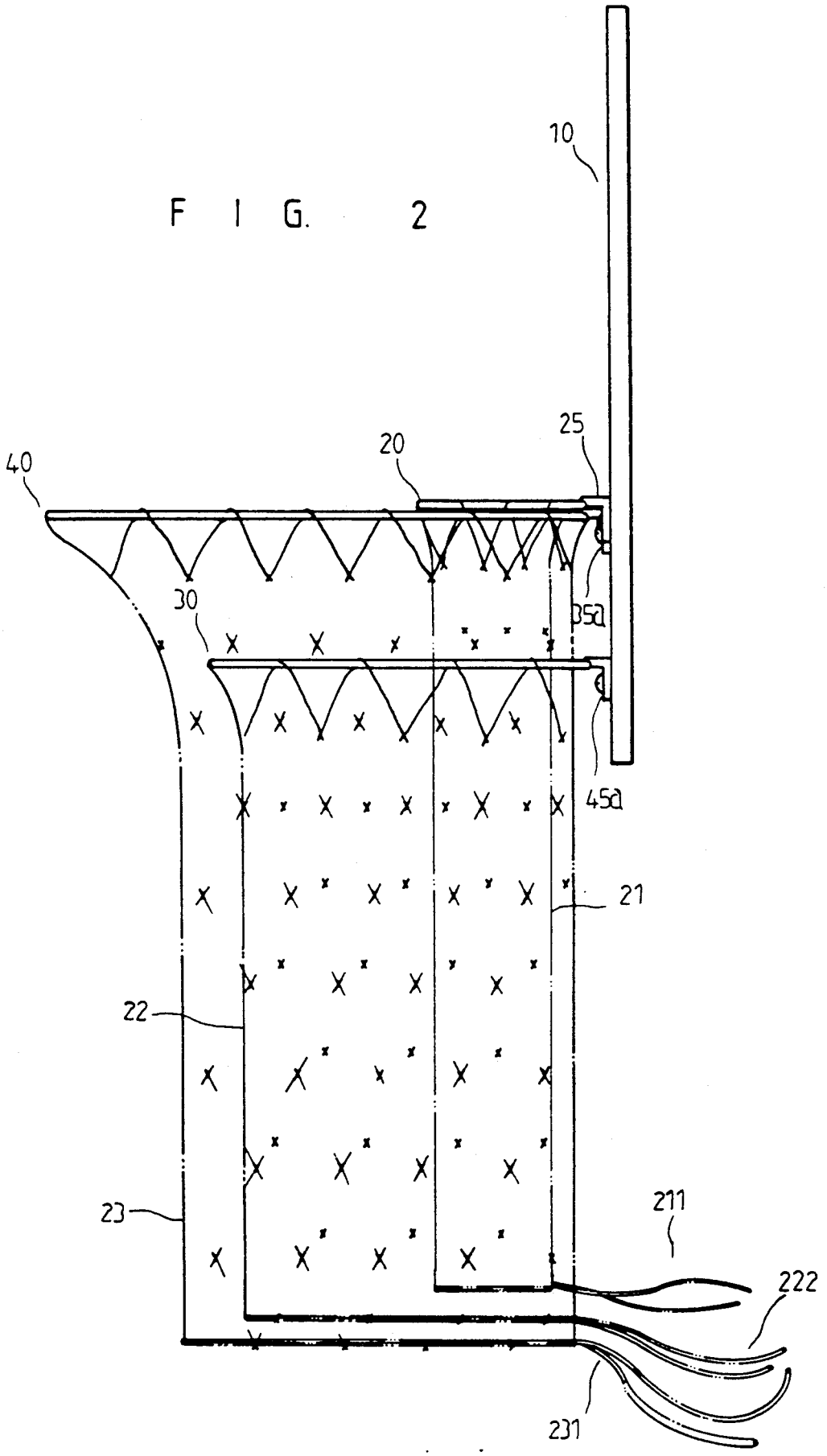
FIG. 2 is a side view of the basketball type training and amusement apparatus of the present invention.

Referring to FIGS. 1 and 2, the basketball type ball throwing training and amusement apparatus of the present invention comprises a flat backboard 10 which acts as a rebound surface for a thrown ball, and three concentric and parallel hoops in target hoop 20, auxiliary hoop 30, and collection hoop 40, which are substantially circular or semi-circular.

Circular target hoop 20 has the smallest diameter of the three hoops and is secured to backboard 10 by a threaded fastener through securing bracket 25. The diameter of the target hoop is still substantially larger than the thrown ball so as to allow it to fall through when thrown in by a user.

Semi-circular auxiliary hoop 30 has a diameter larger than that of the target hoop by slightly more than two diameters of the thrown ball and is concentric with the target hoop. Its vertical position, however, is displaced a distance below the position of target hoop 30 by a margin slightly greater than the diameter of the thrown ball.

A pair of threaded fasteners through rspective securing brackets **35*a* and 35*b* secure auxiliary hoop 30 to backboard 10**.

Semi-circular collection hoop 40 has a diameter of a least six diameters of ball 50 and is concentric with both auxiliary hoop 30 and target hoop 20 which it encircles. Vertically, it is positioned above auxiliary hoop 30 but slightly below target hoop 20.

A pair of threaded fasteners through respective securing brackets **45*a* and 45*b* secure collection hoop 40 to backboard 10**.

An innermost net 21 made from string is attached to target hoop 20 and dangles downward thereof roughly defining a slightly tapered cone.

In similar manner a second net 22 and an outermost net 23 is respectively attached to auxiliary hoops 30 and collection hoop 40.

Outermost net 23 is of greater length and envelopes second net 22 but is not normally in contact when dangling. Likewise innermost net 21 is of shorter length and is enveloped by second net 22 but is not normally in contact.

When in use, a user can make the innermost and smallest target hoop 20 his objective when throwing ball 50, which may pass through target hoop 20 and into innermost net 21 either directly or first rebounding off backboard 10.

Note that target hoop 20 is the highest of the hoops and is directly visible if target hoop 20 is at or below the eye level of the user.

As the space between auxiliary hoop 30 and target hoop 20 is greater than the diameter of the thrown ball, it can enter auxiliary hoop 30. Moreover, due to the relationship of their diameters and relative positions, thrown balls that just miss the rim of target hoop 20, or that roll off as often happens in actual play, would almost surely enter auxiliary hoop 30. The majority of thrown balls that rebound off the rim of target hoop 20 would also enter, with the exception of those thrown balls that rebound at sufficiently high angles and velocity. Thus auxiliary hoop 30 is a realistic secondary target that recieves little interference from target hoop 20.

Collection hoop 40 is large enough to collect most thrown balls 50 that are wide off the mark or that rebound off the rims of target hoop 20 or auxiliary hoop 30 at substantially lateral angles.

With the aid of hoop closure cords 211, 222, and 231 in place on the lower openings of respective innermost net 21, second net 22, and outermost net 23, the lower openings of all three hoops can be pulled closed.

In this way, a succession of balls 50 can be thrown with each net retaining those balls which fall through their respective hoops. The nets can later be re-opened and the number of balls in each net compared for score keeping.

I claim:

1. A basketball type ball throwing training and amusement apparatus comprising:

A flat blackboard; substantially circular target hoop, auxiliary hoop, and collection hoop; an innermost net, a second net, and an outermost net; wherein;

said target hoop is of substantially greater diameter than the ball being thrown, said auxiliary hoop is of a diameter substantially greater than two diameters of said ball, said collection hoop is of a diameter of at least six diameters of said ball, and said target hoop, auxiliary hoop, and collection hoop are disposed concentrically on said backboard, with said auxiliary loop disposed vertically a distance below said target loop substantially greater than the diameter of the ball being thrown, and said collection loop is disposed vertically just below said target loop;

said target loop is secured to said backboard by a threaded fastener and a securing bracket disposed on the rim of said target loop, said auxiliary loop is secured with a pair of threaded fasteners and a pair of securing brackets disposed on the rim of said collection loop;

said innermost net is attached to the rim of said target hoop, said second net is attached to the rim of said auxiliary hoop, and said outermost net is attached to the rim of said collection hoop.

* * * * *